US006769953B1

(12) United States Patent
Sutton et al.

(10) Patent No.: US 6,769,953 B1
(45) Date of Patent: Aug. 3, 2004

(54) SPIN TOP TOY

(76) Inventors: Gail E. Sutton, 28 Ave. at Port Imperial Apt. 233, West New York, NJ (US) 07093; Alan J. Sutton, 1 Carly Ct., Voorhees, NJ (US) 08043

( * ) Notice: Subject to any disclaimer, the term of this patent is extended or adjusted under 35 U.S.C. 154(b) by 0 days.

(21) Appl. No.: 10/653,171

(22) Filed: Sep. 3, 2003

(51) Int. Cl.[7] ..... A63H 1/00
(52) U.S. Cl. ..... 446/256; 446/260
(58) Field of Search ..... 446/256, 257, 446/258, 259, 260, 261, 262, 263, 264, 266, 75, 36, 37, 38, 39, 41, 44, 45

(56) References Cited

U.S. PATENT DOCUMENTS

| | | | | | |
|---|---|---|---|---|---|
| 823,809 | A | * | 6/1906 | Powers | 446/260 |
| 3,224,142 | A | * | 12/1965 | Gustav et al. | 446/138 |
| 4,932,918 | A | * | 6/1990 | Onoda | 446/260 |
| 5,518,437 | A | * | 5/1996 | Nonaka et al. | 446/259 |
| 5,545,068 | A | * | 8/1996 | Asbaghi | 446/39 |
| 5,593,338 | A | * | 1/1997 | Itoh et al. | 446/259 |
| 6,089,946 | A | * | 7/2000 | Yang | 446/259 |
| 6,312,306 | B1 | * | 11/2001 | Kroll | 446/233 |
| 6,364,734 | B1 | * | 4/2002 | Ng | 446/236 |
| 2002/0102907 | A1 | * | 8/2002 | Osawa | 446/256 |
| 2003/0064660 | A1 | * | 4/2003 | Matsukawa | 446/256 |
| 2003/0199222 | A1 | * | 10/2003 | Matsukawa et al. | 446/256 |

* cited by examiner

*Primary Examiner*—Derris H. Banks
*Assistant Examiner*—Ali Abdelwahed
(74) *Attorney, Agent, or Firm*—Barnes & Thornburg LLP

(57) ABSTRACT

A spin top toy comprising a base having a handle, a spring motor frame mounted to the base and having a portion of ratchet mechanism therein, a spin top having a drive mount and a portion of a ratchet mechanism on a bottom side thereof and a spin point on the top side thereof, a spring motor in the spring motor frame including a spring and a spring driven drive shaft having a drive on one end that is engageable with the drive mount on the spin top to permit the spin top to wind the drive shaft and the spring, upon rotation of the spin top in a first direction when the spin top drive mount engages the drive on the drive shaft and wherein the ratchet mechanisms on the spring motor housing and top are engaged to permit the rotation in the first direction, but prohibit rotation in an opposite direction to allow the top to wind the spring, and a release trigger mounted on the base handle operable to raise the drive shaft to a point where the ratchet mechanism on the shaft no longer engages the ratchet mechanism on spring motor housing which causes a wound spring to unwind while rotating the drive shaft and spin top in the opposite direction.

24 Claims, 9 Drawing Sheets

SPIN TOP TOY

BACKGROUND AND SUMMARY

The invention relates to a spin top toy assembly consisting of a spin top launcher, spin tops, power rings, flipper dish, and suitcase container therefore, which container is equipped with arena surface on which the spin tops can spin and interact with other spin tops. The launcher includes a handled base provided with a wind up spring for importing spin to the top and wherein the handle is provided with an actuation mechanism for releasing the energy of a wound spring to impart the desired rotation to the spin top. The spin top is drivingly placed on the launcher and driving engaging the spring through a shaft wherein the spring can be wound by rotation action of the attached spin top.

Other objects, advantages and novel features of the present invention will become apparent from the following detailed description of the invention when considered in conjunction with the accompanying drawings.

DETAILED DESCRIPTION OF THE DRAWINGS

Figure 1:
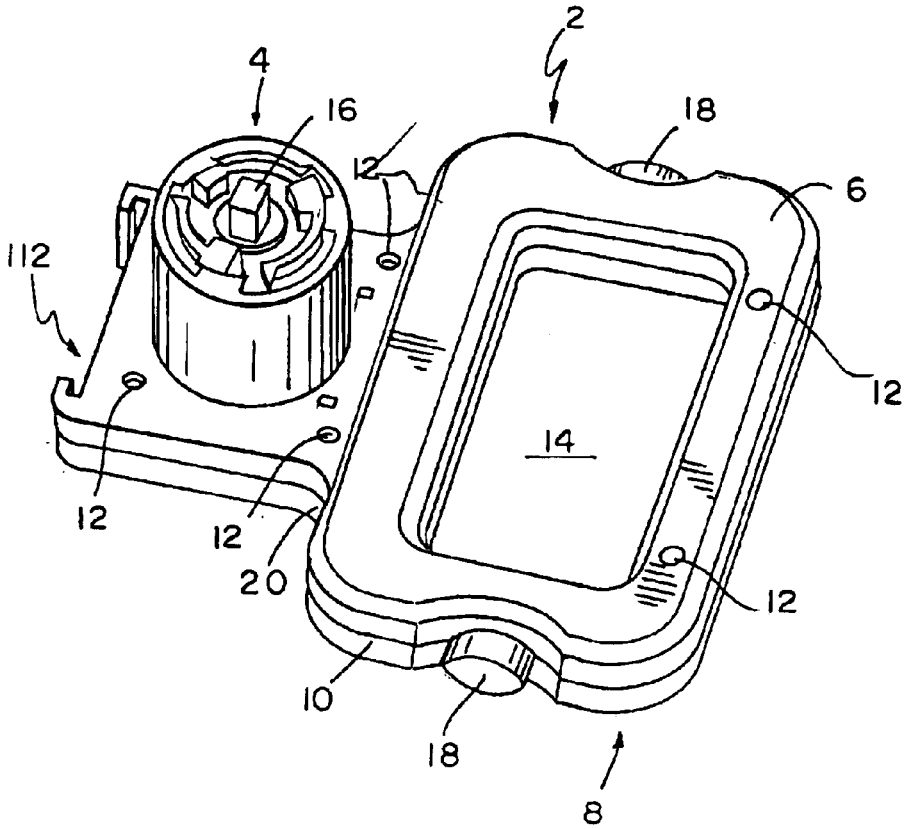
FIG. 1 is a perspective top view of an assembled launcher.
Figure 2:
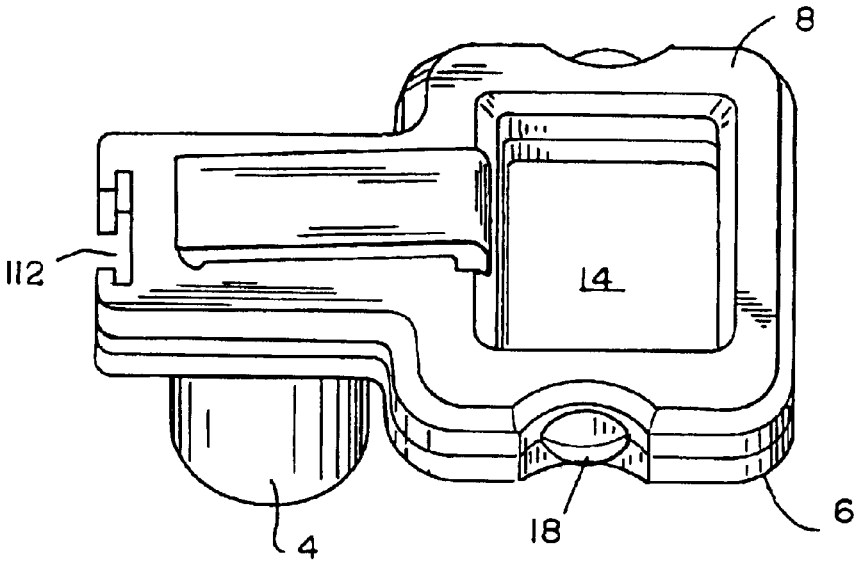
FIG. 2 is a perspective bottom view of the assembled launcher.

FIG. 1 shows the power launcher 2 having a spring motor frame 4 mounted to a top 6 of a base frame 8. A bottom 10 of the base frame 8 is screwed to the top 6 with screws (not shown in FIG. 1) that extend through holes 12 and mate with threaded screw receiving portions (not shown) in the bottom base 10. The base 8 has an opening 14 to form a handle grip. Internally of the spring motor frame is a spring motor shaft 16 which is axially moveable upon pressing of release buttons 18 as will be explained later. The outer long length distance between the two buttons 18 is coordinated with a human hand such that upon gripping of the handle grip a person's thumb overlies one button and the persons middle finger overlies the other button. The users phone dialing finger between the thumb and middle finger fits in the curvature 20, while the users last two fingers fit around the long side of the grip.

Figure 3:
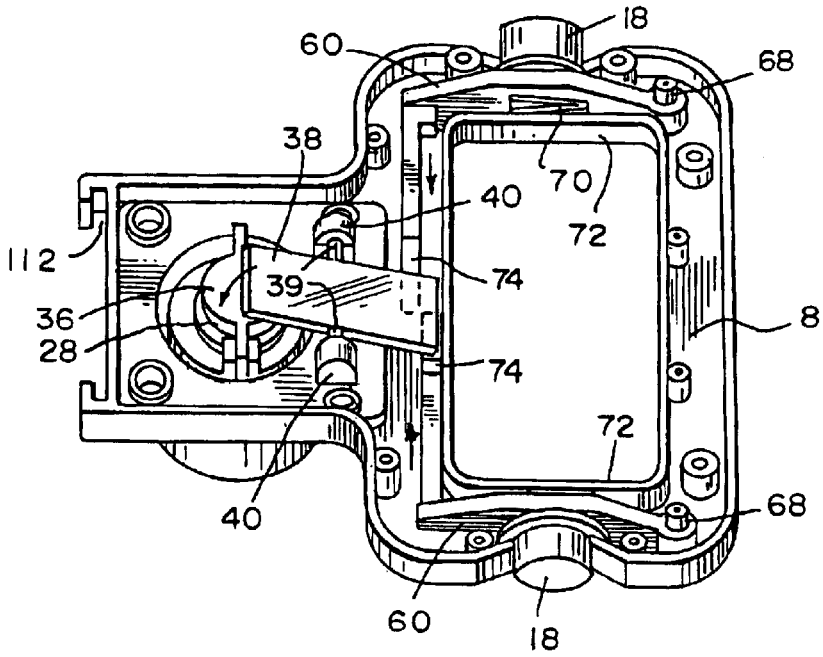
FIG. 3 is a perspective bottom view of the launcher similar to FIG. 2 but with the bottom of the launcher frame removed.
Figure 4:
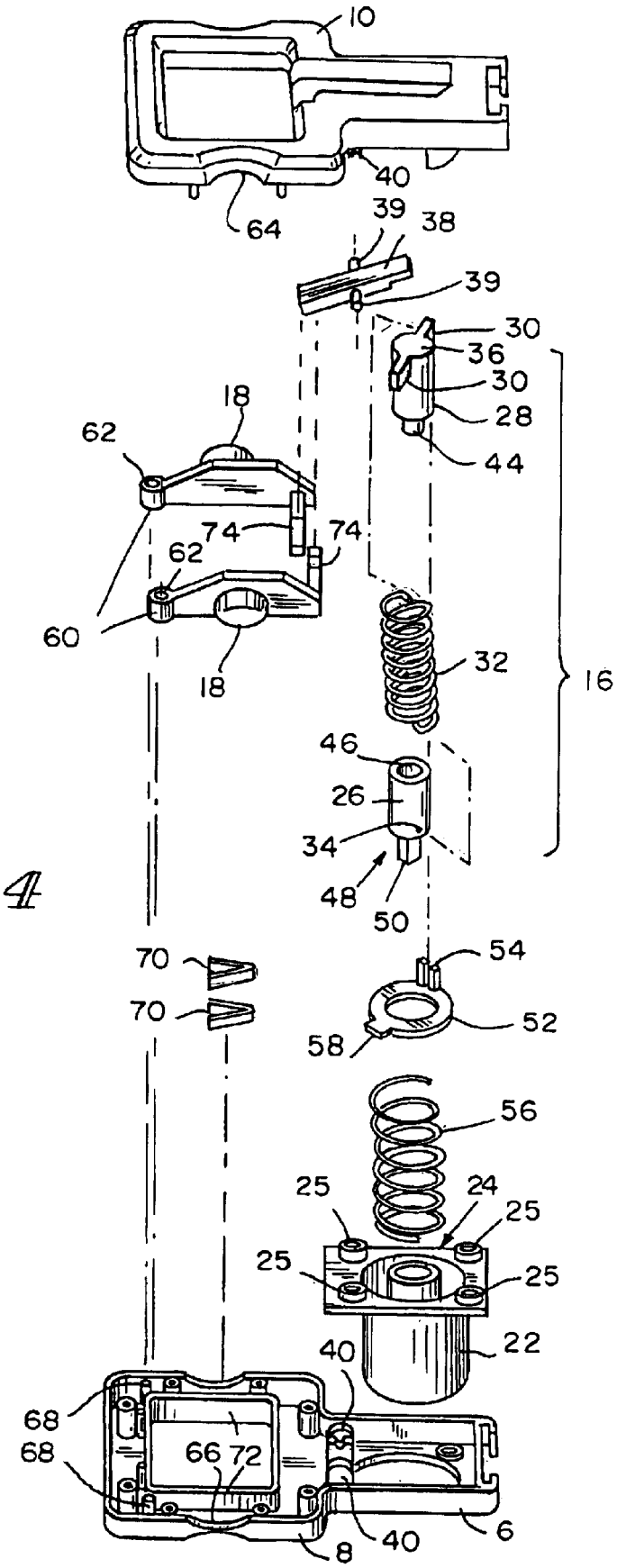
FIG. 4 is an exploded view of the main parts of the launcher.
Figure 6:
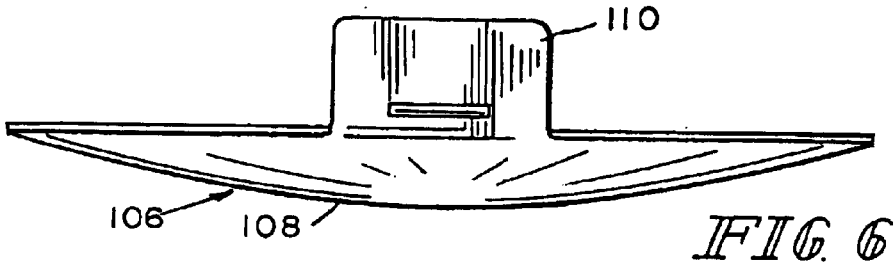
FIG. 6 is a side view of the flipper dish.

The spring motor frame 4 has a rounded exterior portion 22 and a flat square end 24 (see FIG. 4). The flat square end has four holes which are aligned with holes 12 in the narrow portion of the top 6 of base frame 8. Hence the four screws that attach the top 6 of base frame 8 to the bottom 10 of base frame 9 also secure the spring motor frame 4 to the base frame 8. The shaft 16 within the round portion 22 of the spring motor is comprised of a rotary shaft portion 26 and a stationary portion 28. The stationary portion 28 has two arms 30 extending radially outwardly from its axis (see FIG. 4 and FIG. 3). A drive spring 32 surrounds the drive shaft portion 26 and has one end attached to hole 34 in the rotatable shaft portion 26 and another end attached to one of the arms 30. The bottom end of the stationary shaft portion 28 has a flat recess 36 which engages pivoting release lever 38 (see FIG. 4 and 3). The pivoting release lever 38 has two pivot shafts 39 that are rotatably journaled in pivoting release lever mount 40. The other end of the stationary shaft 28 has a reduced round end 44 that supports one circular opened recessed end 46 on one end of rotatable shaft 26. The other end 48 of the rotatable shaft 26 has a rectangular drive lug 50 thereon. A circular retainer clip 52 surrounds the stationary shaft 28 and has a U-shaped dependent ear 54 which fits over one of the arms 30 of the stationary drive shaft 28. An axially compressed spring 56 has one end attached to a radial ear 58 on the retainer clip 52 and another end attached to recess (not shown) formed in the internal outer end of the spring motor frame 4 so the spring 56 can bias the nonrotatable shaft to the bottom of the spring motor frame 4.

Two L-shaped button levers 60 fit in the handle portion of the base frame 8 and have the buttons 18 thereon extend through holes formed by cutouts 64 and 66 formed in the bottom 10 and top 6 of the base frame 8. The sides of the button levers 60 that have the buttons 18 have a circular hole 62 which surrounds pivot pins 68 mounted on the top 6 of the base frame 8 to provide a pivot for the L-shaped button levers 60. A V-shaped spring 70 extends between the button lever 60 and an inner lip 72 on the inside of top 6 of the base frame 8 to bias the buttons 18 outwardly of the handle. The non-pivot ends of the L-shaped levers are formed with angled ramped portions 74 which overlap each other. When the buttons 18 are pushed inwardly of the handle portion of the base frame 8 against the force of V-shaped springs 70, the ramped ends 74 ride up on one another to lift one end of the pivoting release lever 38. The pivoting release lever 38 rotates, so that the end of release lever 38 (underneath the stationary shaft 28 that rests in the flat recess 36) raises the stationary shaft 28 against the force of spring 56, which in turn raises the rotatable shaft 26, which will allow spring 32 to unwind as will be explained later.

Figure 13:
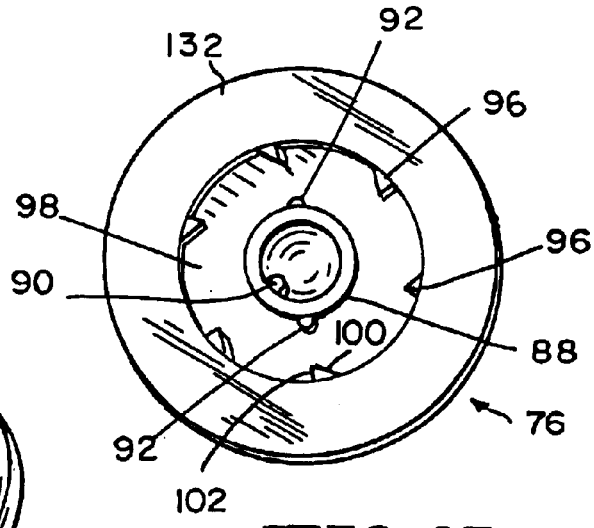
FIG. 13 is a bottom view of the spin top.
Figure 12:
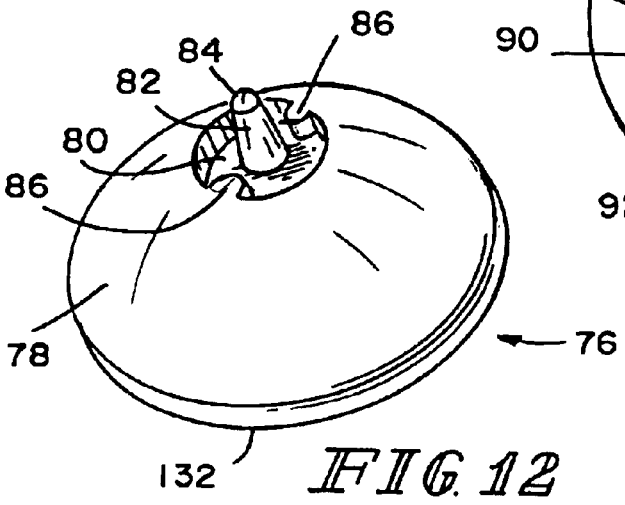
FIG. 12 is a side perspective view of the spin top.

The spin top 76 is shown in FIGS. 12 and 13. The spin top 76 is round with a conical upper surface 78. The upper surface 78 has a central recess 80 with a central spin post 82. A metal spin screw 84 is inserted into the post 82 to provide a hard spin point for the spin top 76. Drive lugs 86 extend into the recess 80 from the outer surface to provide a spin drive to a second spin top 76 placed atop a first spin top 76 as will be explained later. The bottom surface (FIG. 13) of the spin top has a central hub 88 with an internal drive configuration 90 which matches the drive lug 50 configuration on the rotatable shaft 26. When a spin top is placed on the launcher 2, the internal drive configuration 90 on the top 76 engages the drive lug 50 so that upon rotation of the spin top 76 the rotatable shaft is rotated to wind spring 32. Spin top lugs 92 are located on the outside of the bottom hub 88. These lugs are engageable with complimentary spin top lugs 86 located on the outer surface of the recess 80 of the conical surface of a spin top 76. Thus, when one spin top 76 is placed atop another spin top 76, a drive between the two tops occurs by drive lug 86 on the bottom spin top 76 contacting drive lug 92 of the spin top 76 placed thereon.

Ratchet saw teeth 96 are located on the outer surface of a recess 98 surrounding center hub 88 on the bottom side of top 76. These teeth have a ramp surface 100 and a radial surface 102. The ratchet teeth 96 cooperate with a circular flexible ratchet surface 104 internally of spring motor frame 4. The ramp surface 100 allows clockwise rotation of a spin top 76 when mounted on drive lug 50 as the ramp surface 100 rides up the corresponding ramp surface on the circular ratchet surface 104, deflecting surface 104 radially outwardly to let the ratchet teeth 96 pass by, while contacting the radial surface 102 when counter-clockwise rotation is attempted. Thus, spin top 76 can be rotated clockwise to cause drive lug 50 to rotate rotatable shaft 26 and wind up the spring 32. The spring 32 cannot unwind as long as the ratchet teeth on the spin top 76 and frame 4 are engaged due to the cooperating radial surfaces thereof prohibiting counter-clockwise rotation.

Figure 5:
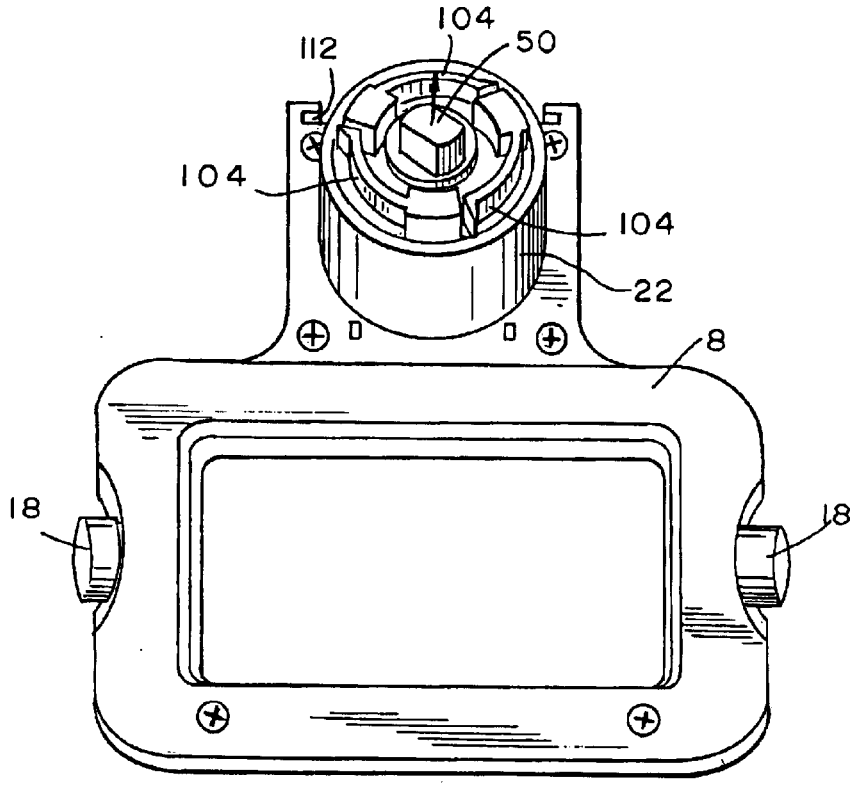
FIG. 5 is a plan view of the launcher.

When push buttons 18 are pushed in, ramp surfaces 74 on the L-shaped button levers 60 override each other and lift up one end of pivoting release lever 38 (as viewed in FIG. 3). This causes the end of the pivot release lever 38 abutting flat access 36 on the non-rotating shaft 28 to move downwardly (FIG. 3) upwardly (FIG. 5) to drive the rotatably shaft 26 in the same direction. The spin top 76 engaged on lug 50 is also moved in the same direction, thus causing the ratchet teeth 96 on the spin top 76 to rise above and be disengaged with ratchet surface 104 in spring motor housing 4, thus allowing wound spring 32 to unwind and impart rotation to the rotatable shaft 26 and spin top 76 engaged therewith. Jerking upwardly and then downwardly on the handle portion of the base frame 8 will release the spin top 76 from the lug 50.

Figure 7:
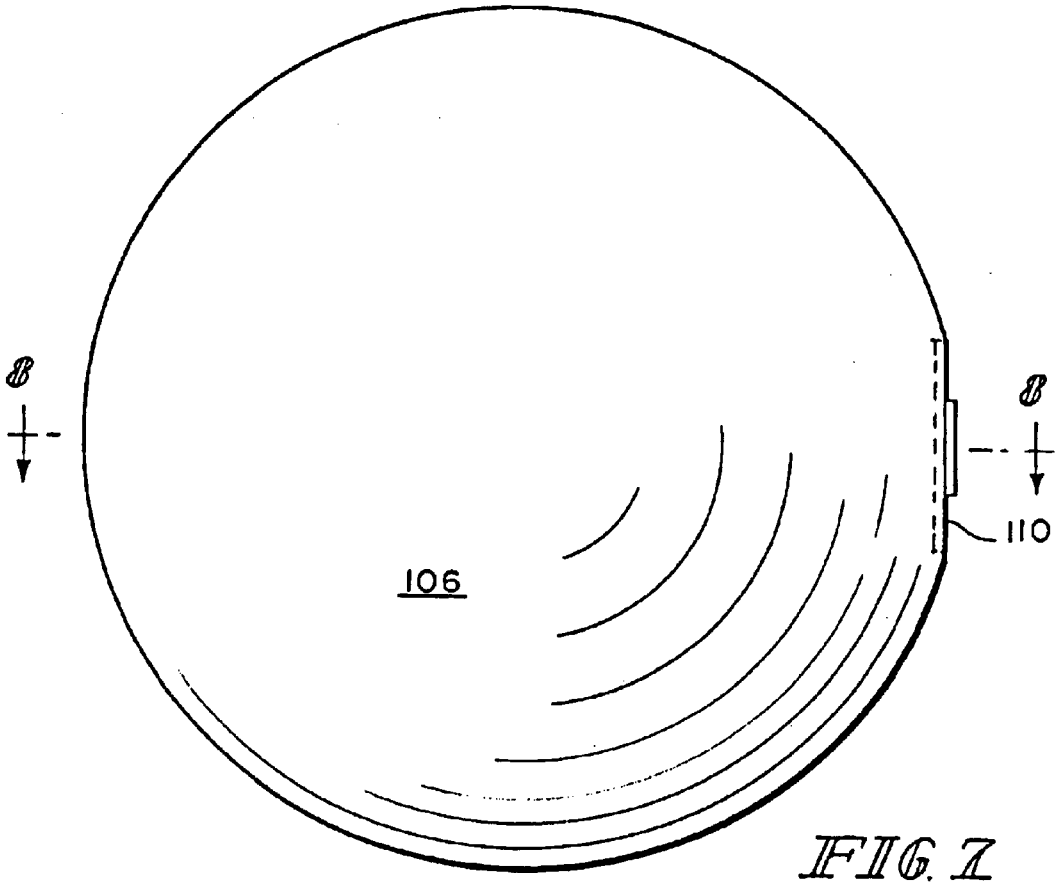
FIG. 7 is a plan view of the flipper dish.
Figure 8:
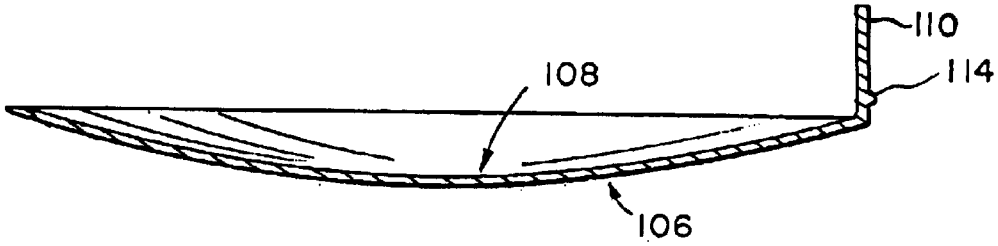
FIG. 8 is a sectional vie of the flipper dish taken along the line 8—8 of FIG. 7.
Figure 9:
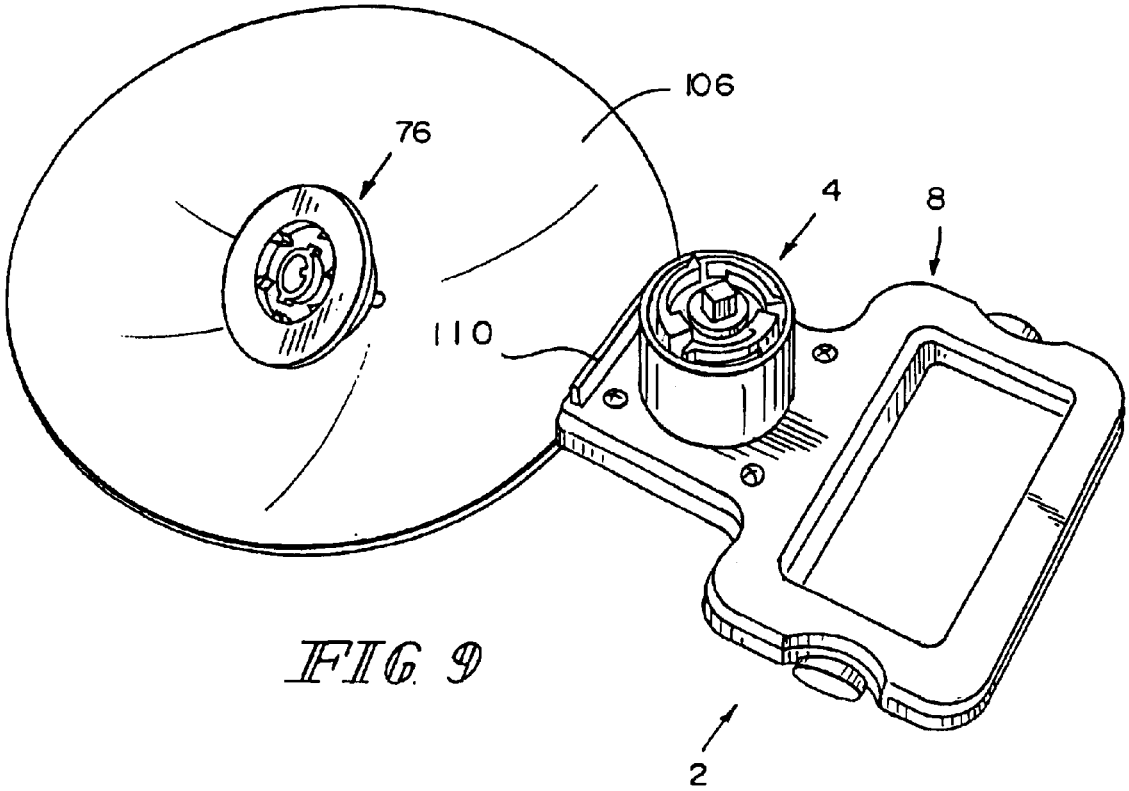
FIG. 9 is a top perspective view of the launcher with the flipper dish attached and with a spin top on the flipper dish.
Figure 10:
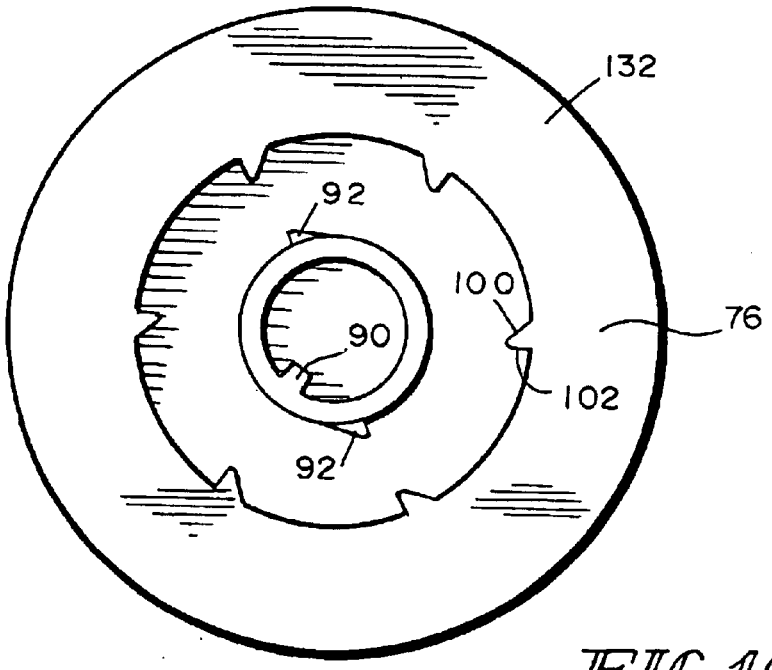
FIG. 10 is a bottom perspective view of the spin top.
Figure 11:
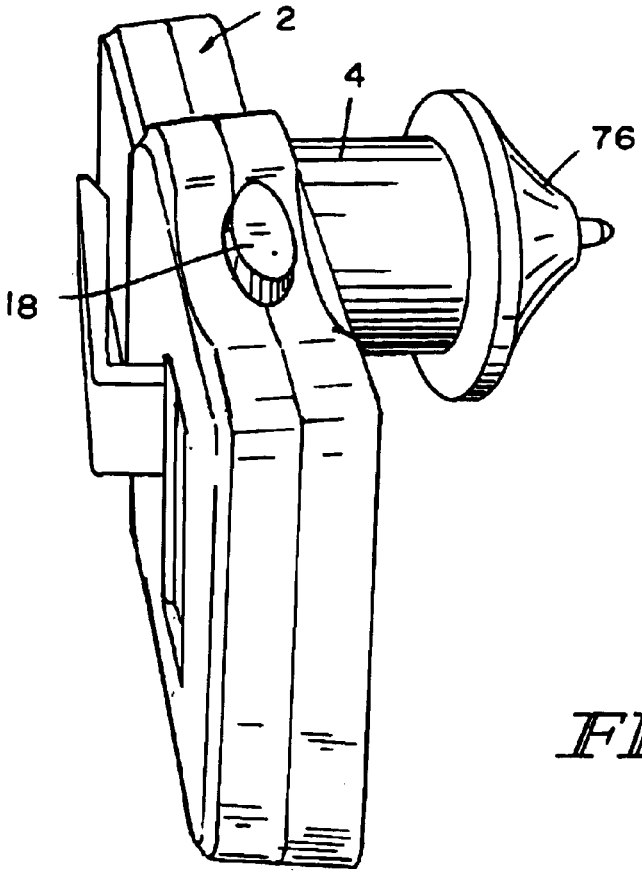
FIG. 11 is a side perspective view of the power launcher with attached spin top.

FIGS. 7–8 show a flipper dish 106 with a concave bottom surface 108 and vertical tab 110. Tab 110 can be inserted into a slot 112 on base frame 8 as shown in FIG. 9. An object of the toy is to catch the spinning released spin top 76 on the concave surface 108 of the flipper dish 106 when the handle is jerked to release the spin top 76. The flipper dish 106 has a rib 114 on the tab 110 which cooperates with a rib (not shown) in the slot 112 to hold the flipper dish 106 onto the launcher 2.

Figure 14:
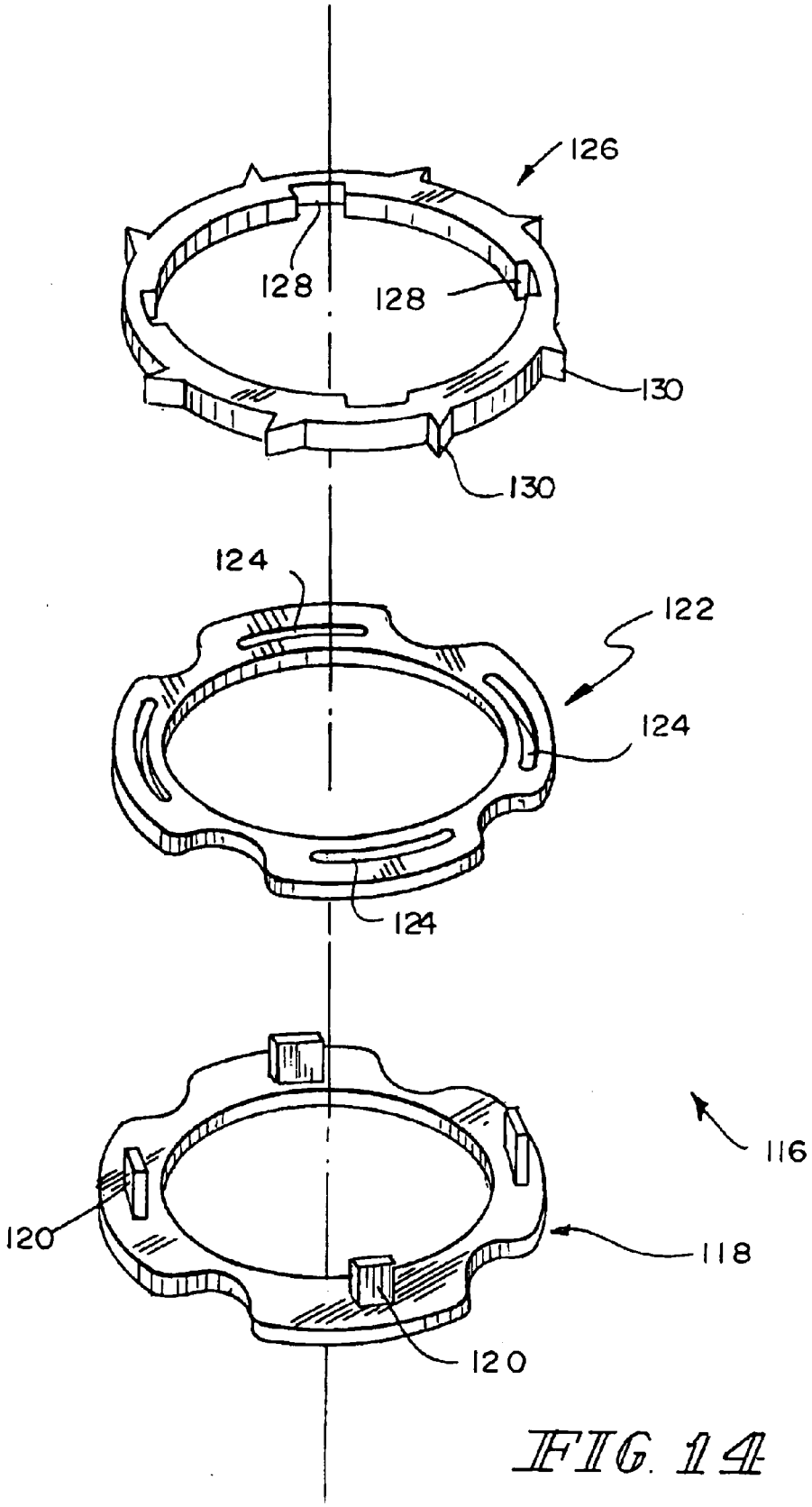
FIG. 14 is an exploded view of a three-piece power ring.
Figure 15:
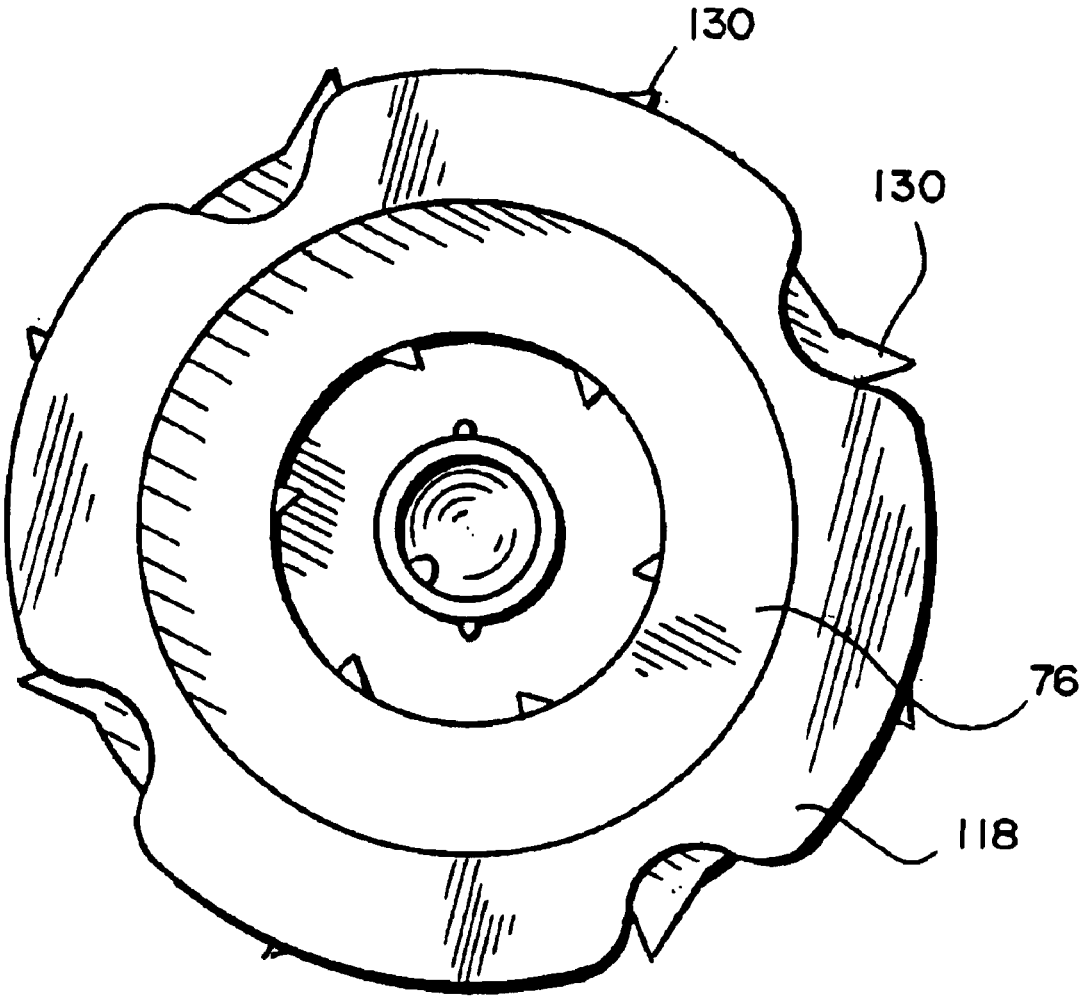
FIG. 15 is a bottom view of an assembled power ring on a spin top.

A three piece power ring accessory 116 (see FIG. 14) is also provided for a spin top 76 and includes a lower ring 118 having upward projections 120, a middle ring 122 having openings 124 which receive the projections 120 on the lower ring and an upper ring 126 having slots 128 receiving the projections 120 in a force fit manner. The projections thus hold the top 126 and bottom 118 rings securely fashioned to one another and with the middle ring 122 sandwiched there between. The top ring 128 also has external attacker knobs 130. The power ring can be placed a top of spin top 76 to frictional rest on conical upper surface 78 of the top to be spun thereby. Alternatively, the bottom ring 118 can lie under the spin top 76 with the middle ring 122 adjacent the peripheral flat bottom edge 132 on the spin top 76 (see FIG. 12). In this manner the peripheral edge 132 of the spin top 76 can also be sandwiched between the upper 126 and lower 118 rings of three piece power ring to more securely attach the power ring 116 to the spin top 76.

When there are multiple users of the toy, the users can have battles where the power ring knobs 130 of one top hit and knock over the opponents top 76 or guard posts (not shown) protecting a player's playing arena.

Figure 16:
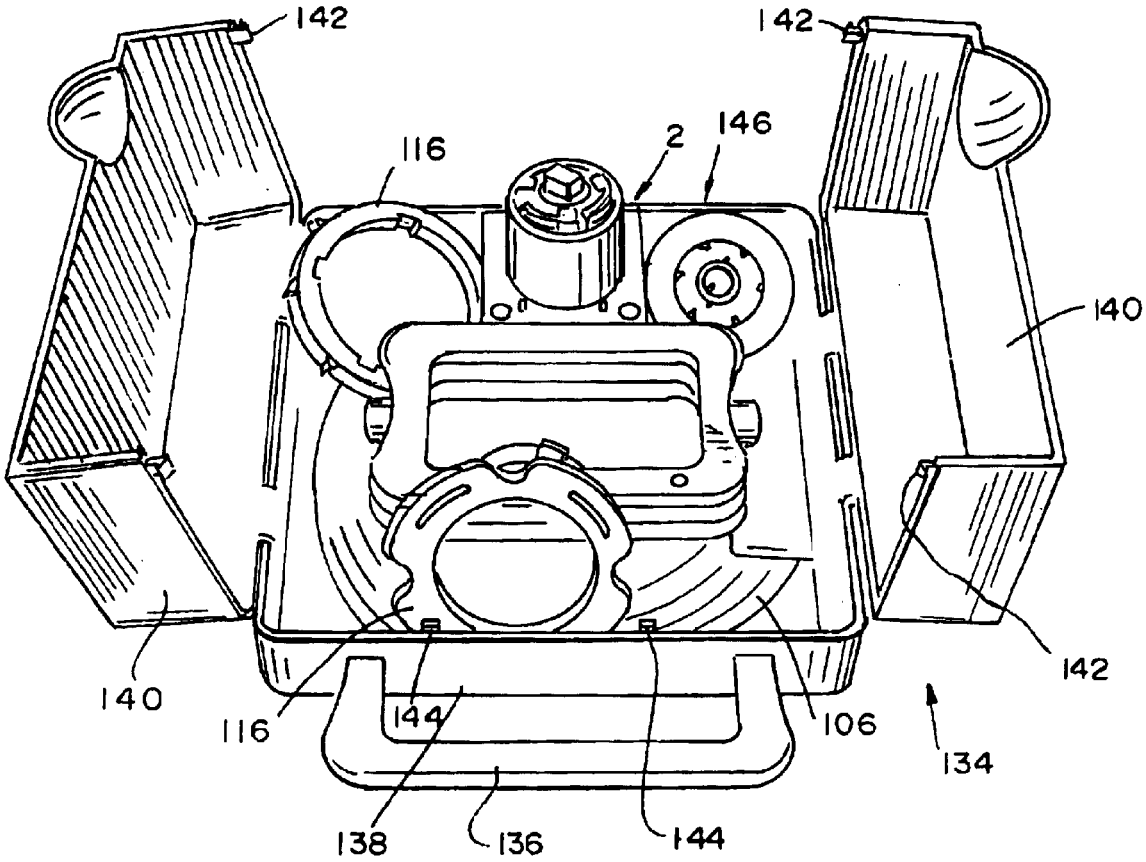
FIG. 16 is a top perspective view of an open suitcase housing container for the spin toy show various parts of the toy therein.
Figure 17:
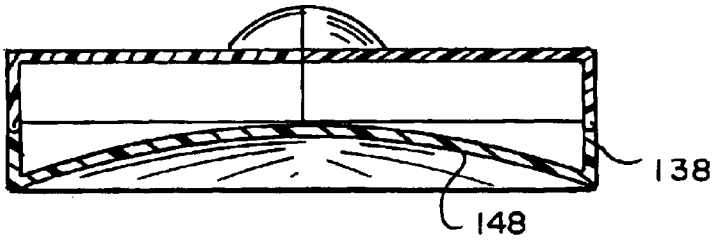
FIG. 17 is a schematic half sectional view of the bottom of the suitcase housing container illustrating its convex area play surface.

The toy includes a handled suitcase container 134 (FIG. 16) having a handle 136 attached to bottom section 138 of the container. Pivotally attached to the bottom section 138 of the suitcase container 134 are two top sections 140 having snaps lugs 142 that cooperate with lock lugs 144 on the bottom section 138 to hold the tops 142 closed. The bottom section 138 and the top sections 140 define an internal cavity 146 to house the power launcher 2, spin tops 76 (only one shown in FIG. 16), power ring 116 and the flipper dish 106. The bottom outside surface 148 of the bottom section 138 of the suitcase container 134 is concave (see FIG. 17) to act as a playing arena for spin tops 76 released from the launcher 2.

While the spin top 76 is shown as a monolithic piece it can be made from several pieces (e.g. a hollow first tapered top, a second ring screwed thereto about its edge which has the inner hub 98 and ratchet teeth 96 thereon). Alternatively, the screw 84 can be used to hold the parts together.

The spin tops 76 can have various colorings or markings thereon. Also, the three pieces of the power ring 116 can be variously colored.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A spin top toy comprising a base having a handle, a spring motor frame mounted to the base and having a portion of a ratchet mechanism therein a spin top having a drive mount and a portion of a ratchet mechanism on a bottom side thereof and a spin point on a top side thereof a spring motor in the spring motor frame including a spring and a spring driven drive shaft having a drive on one end that is engageable with the drive mount on the spin top to permit the spin top to wind the drive shaft and the spring upon rotation of the spin top in a first direction when the spin top drive mount engages the drive on the drive shaft and wherein the ratchet mechanisms on the spring motor frame and top are engaged and permit the rotation in the first direction, but prohibit rotation in an opposite direction to allow the top to wind the spring, and a release trigger mounted on the base handle operable to raise the drive shaft to a point where the ratchet mechanism on the top shaft no longer engages the ratchet mechanism in the spring motor frame which raising causes a wound spring to unwind while rotating the drive shaft and spin top.

2. The spin top toy of claim 1 also including a flipper dish attachable to the base to provide a surface for catching a spinning spin top when the spin top is released from the drive on the drive shaft.

3. The spin top toy of claim 2 wherein the surface of the flipper dish is concave.

4. The spin top toy of claim 1, wherein the top side of the spin top has a recess with a drive therein and wherein the drive therein can drive a second spin top placed atop the spin top, engageable with the drive on the drive shaft, to permit the spring motor to drive both the spin top and the second spin top when a wound drive shaft is raised to disengage the ratchet mechanisms.

5. The spin top toy of claim 2, wherein the top side of the spin top has a recess with a drive therein and wherein the drive therein can drive a second spin top placed atop the spin top, engageable with the drive on the drive shaft, to permit the spring motor to drive both the spin top and the second spin top when a wound drive shaft is raised to disengage the ratchet mechanisms.

6. The spin top toy of claim 3, wherein the top side of the spin top has a recess with a drive therein and wherein the drive therein can drive a second spin top placed atop the spin top, engageable with the drive on the drive shaft, to permit the spring motor to drive both the spin top and the second spin top when a wound drive shaft is raised to disengage the ratchet mechanisms.

7. The spin top toy of claim 1, wherein the spin top toy is also provided with a power ring, the power ring having detachable portions, the power ring adapted to be placed atop a spin top with a frictional engagement with the top side of the spin top so as to be rotated by a spin top when a spin top is rotated by the spring motor.

8. The spin top toy of claim 2, wherein the spin top toy is also provided with a power ring, the power ring having detachable portions, the power ring adapted to be placed atop a spin top with a frictional engagement with the top side of the spin top so as to be rotated by a spin top when a spin top is rotated by the spring motor.

9. The spin top toy of claim 3, wherein the spin top toy is also provided with a power ring, the power ring having detachable portions, the power ring adapted to be placed atop a spin top with a frictional engagement with the top side of the spin top so as to be rotated by a spin top when a spin top is rotated by the spring motor.

10. The spin top toy of claim 4, wherein the spin top toy is also provided with a power ring, the power ring having detachable portions, the power ring adapted to be placed atop a spin top with a frictional engagement with the top side of the spin top so as to be rotated by a spin top when a spin top is rotated by the spring motor.

11. The spin top toy of claim 5, wherein the spin top toy is also provided with a power ring, the power ring having detachable portions, the power ring adapted to be placed atop a spin top with a frictional engagement with the top side of the spin top so as to be rotated by a spin top when a spin top is rotated by the spring motor.

12. The spin top toy of claim 6, wherein the spin top toy is also provided with a power ring, the power ring having detachable portions, the power ring adapted to be placed atop a spin top with a frictional engagement with the top side of the spin top so as to be rotated by a spin top when a spin top is rotated by the spring motor.

13. Wherein the spring top toy of claim 1 is provided with a handled suitcase housing container having at least one top section and a bottom section hinged to one another to provide an internal cavity there between to house the base with its attached spring motor and spin top.

14. Wherein the spring top toy of claim 2 is provided with a handled suitcase housing container having at least one top section and a bottom section hinged to one another to provide an internal cavity there between to house the base with its attached spring motor and spin top and wherein the flipper dish is attachable to the bottom section to be carried thereby.

15. Wherein the spring top toy of claim 3 is provided with a handled suitcase housing container having at least one top section and a bottom section hinged to one another to provide an internal cavity there between to house the base with its attached spring motor and spin top and where the cavity is large enough to contain several spin tops.

16. Wherein the spring top toy of claim 4 is provided with a handled suitcase housing container having at least one top section and a bottom section hinged to one another to provide an internal cavity there between to house the base with its attached spring motor and spin top wherein the cavity is large enough to carry at least two spin tops and a power ring.

17. Wherein the spring top toy of claim 5 is provided with a handled suitcase housing container having at least one top section and a bottom section hinged to one another to provide an internal cavity there between to house the base with its attached spring motor and spin top wherein the housing container bottom section is provided with a concaved outer surface which can be utilized to catch and support multiple spinning tops to provide a battle arena for spinning tops.

18. Wherein the spring top toy of claim 6 is provided with a handled suitcase housing container having at least one top section and a bottom section hinged to one another to provide an internal cavity there between to house the base with its attached spring motor and spin top and wherein the flipper dish is attachable to the bottom section to be carried thereby wherein the housing container bottom section is provided with a concaved outer surface which can be utilized to catch and support multiple spinning tops to provide a battle arena for spinning tops.

19. Wherein the spring top toy of claim 7 is provided with a handled suitcase housing container having at least one top section and a bottom section hinged to one another to provide an internal cavity there between to house the base with its attached spring motor and spin top and where the cavity is large enough to contain several spin tops wherein the housing container bottom section is provided with a concaved outer surface which can be utilized to catch and support multiple spinning tops to provide a battle arena for spinning tops.

20. Wherein the spring top toy of claim 8 is provided with a handled suitcase housing container having at least one top section and a bottom section hinged to one another to provide an internal cavity there between to house the base with its attached spring motor and spin top wherein the cavity is large enough to carry at least two spin tops and a power ring wherein the housing container bottom section is provided with a concaved outer surface which can be utilized to catch and support multiple spinning tops to provide a battle arena for spinning tops.

21. Wherein the spring top toy of claim 9 is provided with a handled suitcase housing container having at least one top section and a bottom section hinged to one another to provide an internal cavity there between to house the base with its attached spring motor and spin top wherein the cavity is large enough to carry at least two spin tops and a power ring wherein the housing container bottom section is provided with a concaved outer surface which can be utilized to catch and support multiple spinning tops to provide a battle arena for spinning tops.

22. Wherein the spring top toy of claim 10 is provided with a handled suitcase housing container having at least one top section and a bottom section hinged to one another to provide an internal cavity there between to house the base with its attached spring motor and spin top wherein the cavity is large enough to carry at least two spin tops and a power ring wherein the housing container bottom section is provided with a concaved outer surface which can be utilized to catch and support multiple spinning tops to provide a battle arena for spinning tops.

23. Wherein the spring top toy of claim 11 is provided with a handled suitcase housing container having at least one top section and a bottom section hinged to one another to provide an internal cavity there between to house the base with its attached spring motor and spin top wherein the cavity is large enough to carry at least two spin tops and a power ring wherein the housing container bottom section is provided with a concaved outer surface which can be utilized to catch and support multiple spinning tops to provide a battle arena for spinning tops.

24. Wherein the spring top toy of claim 12 is provided with a handled suitcase housing container having at least one top section and a bottom section hinged to one another to provide an internal cavity there between to house the base with its attached spring motor and spin top wherein the cavity is large enough to carry at least two spin tops and a power ring wherein the housing container bottom section is provided with a concaved outer surface which can be utilized to catch and support multiple spinning tops to provide a battle arena for spinning tops.

* * * * *